US007228768B1

(12) United States Patent
Kim

(10) Patent No.: US 7,228,768 B1
(45) Date of Patent: Jun. 12, 2007

(54) SELF-ADJUSTABLE UNIVERSAL SPANNER WITH VARIABLE JAW SPACING

(76) Inventor: Kwang-Moo Kim, #85-220 Ah Hyun Dong, Mapoku (KR)

( * ) Notice: Subject to any disclaimer, the term of this patent is extended or adjusted under 35 U.S.C. 154(b) by 0 days.

(21) Appl. No.: 11/360,172

(22) Filed: Feb. 23, 2006

(30) Foreign Application Priority Data

Dec. 15, 2005 (KR) ..... 10-2005-0123703

(51) Int. Cl.
*B25B 13/12* (2006.01)

(52) U.S. Cl. ..... 81/179; 81/58.2

(58) Field of Classification Search ..... 81/179, 81/126, 129, 186, 58.2
See application file for complete search history.

(56) References Cited

U.S. PATENT DOCUMENTS 733,525 A * 7/1903 Worden ..... 81/179
1,048,380 A * 12/1912 Youngquist ..... 81/179
2,795,160 A * 6/1957 Blasdell ..... 81/179
5,768,958 A * 6/1998 Gamble ..... 81/58.2
6,202,516 B1 3/2001 Kim
6,945,143 B2 9/2005 Kim
7,111,529 B2 * 9/2006 Pradelski ..... 81/179

* cited by examiner

*Primary Examiner*—Hadi Shakeri
(74) *Attorney, Agent, or Firm*—MH2 Technology Law Group

(57) ABSTRACT

Provided is a self-adjustable universal spanner employing a variable jaw sizing feature including: a spanner head having an upper slide groove and a lower groove for inserting a bolt therebetween; a ratcheting size-adjustment member slidable along the upper groove to fasten and unfasten the bolt; and a jaw sizing member movable in the lower groove in a stepped manner to vary a width between the ratcheting size-adjustment member and the jaw sizing member so that the spanner can fasten and unfasten various sizes of bolts. In addition, a pair of bolt holding members may be installed between the upper and lower grooves. Therefore, the present invention is capable of fastening or unfastening more sizes of bolts than that of a single spanner head. In addition, it is possible to fasten bolts and nuts using a user's one hand by employing a bolt holding member.

14 Claims, 4 Drawing Sheets

SELF-ADJUSTABLE UNIVERSAL SPANNER WITH VARIABLE JAW SPACING

This U.S. non-provisional patent application claims priority under 35 U.S.C. § 119 of Korean Patent Application 10-2005-0123703 filed on Dec. 15, 2005 the entire contents of which are hereby incorporated by reference.

BACKGROUND OF THE INVENTION

1. Field of the Invention

The present invention relates to a self-adjustable universal spanner and, more particularly, to a self-adjustable universal spanner employing a size enlarger capable of changing a dimension of the spanner in order to fasten or unfasten various bolts and nuts having different diameters.

2. Description of Related Art

Conventionally, spanners for fastening or unfastening bolts and nuts may be classified into a general spanner set, a ratchet spanner set, a monkey spanner, and so on. The general spanner set is comprised of a plurality of spanners having different sizes so that they should perform repeated operations of insertion and separation into/from bolts and nuts, thereby making a user perform troublesome operations. The ratchet spanner set includes a ratchet handle for continuously operating the spanner, and sockets having various sizes inserted into the ratchet handle. The monkey spanner can adjust its size by rotating a screw to accommodate various sizes of bolts and nuts; however, it is also troublesome to operate the spanner due to repeated insertion and separation.

In addition, in the case of the conventional ratchet spanner set, since the ratchet handle is operated spaced apart from a bolt by a large gap due to the socket inserted into a head of the bolt, a user should use one hand to grip the ratchet handle and the other hand to grip the socket on the bolt head in order to perform a stable operation. Further, the general spanner set and the monkey spanner also require using both hands to prevent the bolt head from separating from the spanner.

Moreover, the conventional spanners should have a plurality of spanners or sockets corresponding to sizes of bolts and nuts. Therefore, when any one of the tools is lost during the operation, the operation may be stopped due to the lost size. In addition, due to inconvenience of storage and management of numerous parts, it is very difficult to use the conventional spanners in dangerous environment such as a high attitude and so on.

In order to solve the problems, spanners disclosed in U.S. Pat. Nos. 6,202,516 and 6,945,143 have been proposed. However, the spanner of '516 patent has a structure that a bracket is installed at an outer surface of the spanner head to prevent a ratchet member and a size adjustment member from retracting and separating from a slide groove, still remaining problems such as lack of durability and inconvenience of use. In addition, in the spanner of '143 patent, a semi-circular projection of a ratchet and side-adjustment member is inserted into a semi-circular slide groove formed at an upper jaw of a spanner head to be securely slid along the groove, a sloped surface of the adjustment member is in contact with a bottom surface of the slide groove of the spanner head, and an upper surface of the adjustment member is in contact with a sloped surface of the upper jaw of the spanner head, thereby making the adjustment member turn over to prevent retreat of the adjustment member. However, an angle between the bottom surface of the lower jaw of the spanner head and the bottom surface of the slide groove has a range of 147±3° due to small friction therebetween, thereby accommodating only two or three sizes of bolts. In order to accommodate more sizes, the head should have a larger size, and the ratchet and size-adjustment member should be larger, thereby generating problems such as lack of durability and bolt braking.

SUMMARY OF THE INVENTION

Therefore, to solve the problem described hereinabove, an object of the present invention is to provide a self-adjustable universal spanner with a size enlarger capable of fastening or unfastening various sizes of bolts more than twelve using one spanner head.

Another object of the present invention is to provide a self-adjustable universal spanner with a size enlarger capable of fastening bolts and nuts using a user's one hand by employing a bolt holding member.

A self-adjustable universal spanner employing a size enlarger in accordance with a first aspect of the present invention may include: a spanner head having an upper slide groove and a lower groove for inserting a bolt therebetween; a ratchet and size-adjustment member slidable along the upper slide groove to fasten and unfasten the bolt; and a size enlarger movable in the lower groove in a stepped manner to enlarge a width between the ratchet and size-adjustment member and the size enlarger so that the spanner can fasten and unfasten various sizes of bolts.

In the spanner head, the upper slide groove formed at its upper part includes a guide rail projected from an upper surface of the slide groove, a sloped surface formed at a distal end of the upper surface of the slide groove, a sidewall formed at one side of the slide groove, a cylindrical groove formed at a rear part of the slide groove, teeth formed at a lower surface of the slide groove, and the lower groove includes a stepped projection formed at a lower part of the spanner head, semi-circular grooves formed at an upper surface of the stepped projection, and a sloped surface formed at a lowermost part of the spanner head.

In addition, the ratchet and size-adjustment member includes a body, a conical rod engaged with the body at one end and inserted into the cylindrical groove of the slide groove, a coil spring installed around the conical rod, a wheel engaged with one end of the body, and a guide groove having teeth formed on an upper surface of the ratchet and size-adjustment member.

Further, the size enlarger includes stepped sidewalls formed at one end and a guide groove inserted into the stepped projection, a fixing member for fixing the size enlarger to one of two steps, a receiving groove for receiving the fixing member, a cylindrical groove formed at the receiving groove, and a ball and a spring inserted into the cylindrical groove to bias the fixing member upward.

In another embodiment, the self adjustable universal spanner with a size enlarger may further include: seating grooves formed between the slide groove and the stepped projection, and having a threaded hole and a pair of semi-spherical grooves at both sides thereof; and a pair of bolt holding members having a threaded hole through which a screw is engaged, and a semi-spherical projection corresponding to the semi-spherical groove.

In still another embodiment, a cutout part may be formed at one side of the body to help slide movement along the sidewall of the slide groove, a pin is inserted through pinholes formed at both sidewalls of the guide groove to be hooked by the guide rail of the slide groove to prevent the adjustment member from separating from the slide groove, and the wheel is rotatably engaged with a distal end of the body by a pin passing through pinholes.

In addition, a contact surface may be formed under the stepped sidewalls to be in contact with the sloped surface of the spanner head.

In still another embodiment, the fixing member has a pinhole through which a pin passes, semi-circular grooves formed at one end and a lower surface thereof corresponding to positions of two steps of the size enlarger, and semi-spherical projections formed at the other end and an upper surface thereof corresponding to the semi-circular grooves above the stepped projection.

In still another embodiment, the pin passes through the pinholes of the size enlarger so that the fixing member can be pivoted about the pin.

In still another embodiment, when the size enlarger is engaged with the upper part of the stepped projection to fasten various sizes of bolts, the semi-spherical projection of the fixing member is inserted into the semi-circular groove of the spanner head, and when the size enlarger is engaged with the lower part of the stepped projection to fasten the other sizes of bolts, the semi-spherical projection of the fixing member is inserted into the semi-circular groove of the spanner head.

In still another embodiment, the wheel has a hole having an inner diameter larger than an outer diameter of the pin so that the wheel is freely rotated around the pin.

In still another embodiment, the slide groove has the teeth formed at its lower surface, and the teeth are inclined downward as they go toward a distal end of the spanner head.

In still another embodiment, when the spanner head is rotated clockwise in order to fasten the bolt, a rear end of the ratchet and size-adjustment member is in contact with the teeth, and the teethed groove of the ratchet and size-adjustment member is in contact with a front end of the guide rail so that the bolt can be securely fastened.

In addition, when the spanner head is rotated counter-clockwise in order to unfasten the bolt, the conical rod is guided into the cylindrical groove so that the ratchet and size-adjustment groove is retreated backward.

Further, the pinhole has an inner diameter larger than a diameter of the pin so that the pinhole is cooperated with the spring and the ball to resiliently pivot the fixing member.

BRIEF DESCRIPTION OF THE DRAWINGS

The foregoing and other objects, features and advantages of the invention will be apparent from the more particular description of a preferred embodiment of the invention, as illustrated in the accompanying drawing. The drawing is not necessarily to scale, emphasis instead being placed upon illustrating the principles of the invention.

DETAILED DESCRIPTION OF THE INVENTION

Figure 1:
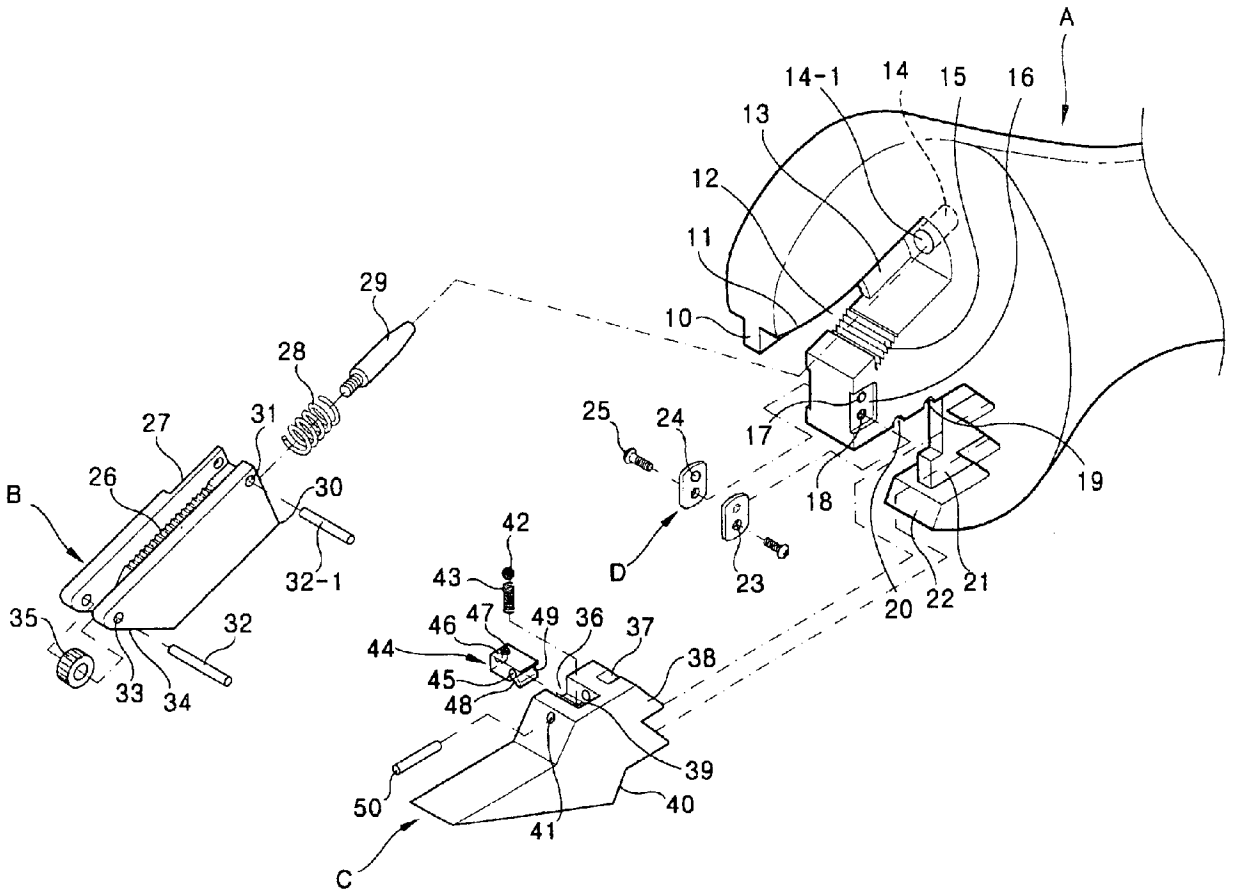
FIG. 1 is an exploded perspective view of a self-adjustable universal spanner with a size enlarger in accordance with the present invention.

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals designate like elements throughout the specification.

Figure 2:
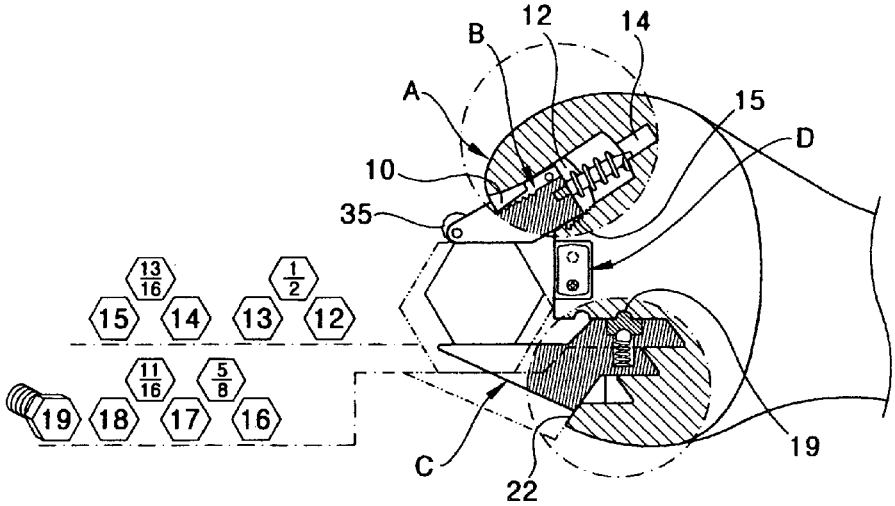
FIG. 2 is view for explaining adaptation of twelve sizes of bolts to a self-adjustable universal spanner with a size enlarger.
Figure 3:
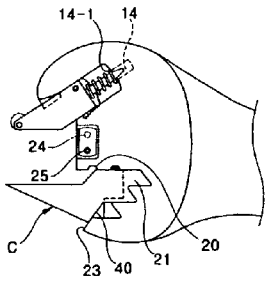
FIG. 3 is a side view of a size enlarger inserted into an upper groove of a spanner in accordance with the present invention.
Figure 4:
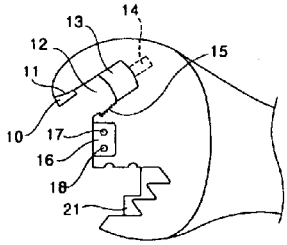
FIG. 4 is a side view of a spanner head before components are assembled.
Figure 5:
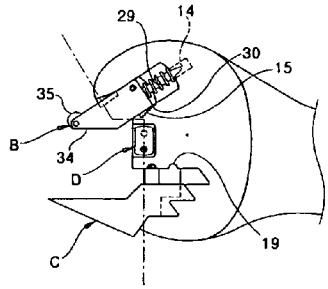
FIG. 5 is a side view of a size enlarger inserted into a lower groove of a spanner in accordance with the present invention.

FIG. 1 is an exploded perspective view of a self-adjustable universal spanner with a size enlarger in accordance with the present invention, FIG. 2 is view for explaining adaptation of twelve sizes of bolts to a self-adjustable universal spanner with a size enlarger, FIG. 3 is a side view of a size enlarger inserted into an upper groove of a spanner in accordance with the present invention, FIG. 4 is a side view of a spanner head before components are assembled, and FIG. 5 is a side view of a size enlarger inserted into a lower groove of a spanner in accordance with the present invention.

As shown in FIGS. 1 through 5, a self adjustable universal spanner with a size enlarger in accordance with the present invention includes a spanner head A, a ratchet and size-adjustment member B, a size enlarger C, and a pair of bolt head holding members D.

The spanner head A includes a slide groove 12 for guiding the ratchet and size-adjustment member B, a stepped projection 21 for guiding the size-enlarger C, and a pair of seating grooves 16 for seating the bolt head holding members D therein.

A guide rail 10 is projected from an upper surface of the slide groove 12 to guide the ratchet and size-adjustment member B. A sloped surface 11 is formed at a distal end of the upper surface of the slide groove 12. A sidewall 13 is formed at one side of the slide groove 12 to prevent separation of the adjustment member C. A cylindrical groove 14 is formed at a rear part of the slide groove 12, and teeth 15 are formed at a lower surface of the slide groove 12.

The seating grooves 16 are formed between the slide groove 12 and the stepped projection 21 to provide attachment to the bolt head holding members D, and include a threaded hole 18 and a pair of semi-spherical grooves 17 at both sides thereof.

Semi-circular grooves 19 and 20 are formed at an upper surface of the stepped projection 21, and a sloped surface 22 is formed at a lowermost part of the spanner head A.

The ratchet and size-adjustment member B includes a body, a conical rod 29 engaged with the body at one end and inserted into the cylindrical groove 14 of the slide groove 12, a coil spring 28 installed around the conical rod 29, and a wheel 35 engaged with one end of the body. A guide groove 26 having teeth are formed on an upper surface of the ratchet and size-adjustment member B to guide movement of the adjustment member B along the guide rail 10 of the slide groove 12. A cutout part 27 is formed at one side of the body to help slide movement along the sidewall 13 of the slide groove 12. A pin 32-1 is inserted through pinholes 31 formed at both sidewalls of the guide groove 26 to be hooked by the guide rail 10 of the slide groove 12 to prevent the adjustment member B from separating from the slide groove 12. The wheel 35 is rotatably engaged with a distal end of the body by a pin 32 passing through pinholes 33.

Each of the bolt head holding members D has a threaded hole 23 through which a screw 25 is engaged and a semi-spherical projection 24 corresponding to the semi-spherical groove 17.

The size enlarger C includes stepped sidewalls 38 formed at one end and a guide groove 37 inserted into the stepped projection 21, a fixing member 44 for fixing the size enlarger to one of two steps, a receiving groove 36 for receiving the fixing member 44. A cylindrical groove 39 is formed at the receiving groove 36, and a ball 42 and a spring 43 are inserted into the cylindrical groove 39 to bias the fixing member 44 upward. A contact surface 40 is formed under the stepped sidewalls 38 to be in contact with the sloped surface 22 of the spanner head A.

The fixing member 44 has a pinhole 45 through which a pin 50 passes, semi-circular grooves 48 formed at one end and a lower surface thereof corresponding to positions of two steps of the size enlarger C, and semi-spherical projections formed at the other end and an upper surface thereof corresponding to the semi-circular grooves 19 and 20 above the stepped projection 21. The pin 50 passes through the pinhole 45 and pinholes 41 of the size enlarger C so that the fixing member 44 can be pivoted about the pin 50.

As can be seen from FIG. 2, various sizes of bolts and nuts, for example, twelve sizes of bolts and nuts can be fastened or unfastened using the self-adjustable universal spanner with a size enlarger in accordance with the present invention. As shown in FIG. 2, six sizes of bolts, e.g., 12 mm~16 mm, can be fastened in a state that the size enlarger C is engaged with an upper part of the stepped projection 21. At this time, the semi-spherical projection 47 of the fixing member 44 is inserted into the semi-circular groove 19 of the spanner head A. In addition, the other six sizes of bolts, e.g., 16 mm~19 mm, can be fastened in a state that the size enlarger C is engaged with a lower part of the stepped projection 21. At this time, the semi-spherical projection 46 of the fixing member 44 is inserted into the semi-circular groove 20 of the spanner head A as shown in a dotted line.

As shown in FIG. 3, when the size enlarger C is engaged with the upper part of the stepped projection 21 to fasten the six bolts, the semi-spherical projection 47 of the fixing member 44 is inserted into the semi-circular groove 19 of the spanner head A.

In addition, as shown in FIG. 5, when the size enlarger C is engaged with the lower part of the stepped projection 21 to fasten the other six bolts, the semi-spherical projection 46 of the fixing member 44 is inserted into the semi-circular groove 20 of the spanner head A.

Figure 6:
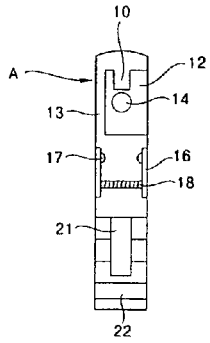
FIG. 6 is a front view of a spanner head when seen from an arrow direction of FIG. 3.
Figure 7:
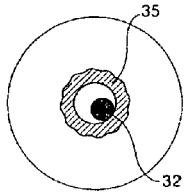
FIG. 7 is a side of a wheel having a pinhole through which a pin having a diameter smaller than that of the pinhole is inserted.
Figure 8:
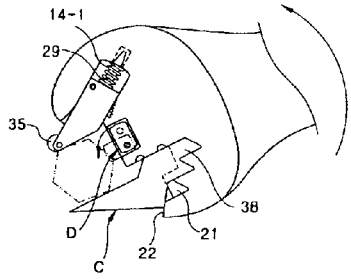
FIG. 8 is a side view of a spanner head rotated in a bolt unfastening direction and a bolt head holding member deployed in a use state.
Figure 9:
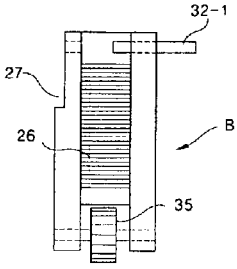
FIG. 9 is a plan view of a ratchet and size-adjustment member.
Figure 10:
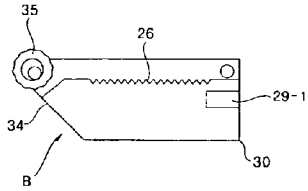
FIG. 10 is a side view of a ratchet and size-adjustment member.
Figure 11:
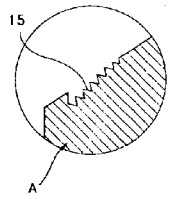
FIG. 11 is an enlarged side view of a slide groove having a teeth formed at an upper surface thereof.
Figure 12:
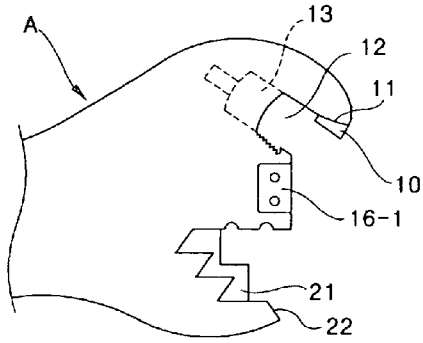
FIG. 12 is a side view of an opposite side of a spanner head.

FIG. 6 is a front view of a spanner head when seen from an arrow direction of FIG. 3, FIG. 7 is a side of a wheel having a pinhole through which a pin having a diameter smaller than that of the pinhole is inserted, FIG. 8 is a side view of a spanner head rotated in a bolt unfastening direction and a bolt head holding member deployed in a use state, FIG. 9 is a plan view of a ratchet and size-adjustment member, FIG. 10 is a side view of a ratchet and size-adjustment member, FIG. 11 is an enlarged side view of a slide groove having a teeth formed at an upper surface thereof, and FIG. 12 is a side view of an opposite side of a spanner head.

As shown in FIG. 6, the cylindrical groove 14 is formed under the guide rail 10 of the slide groove 12, and the sidewall 13 is formed at one side of the slide groove 12. The pair of semi-spherical grooves 17 are formed at surfaces of the pair of seating grooves 16, and the threaded hole 18 is formed to insert a screw for fastening the bolt head holding members D. The sloped surface 22 is formed under the stepped projection 21 to be in contact with the contact surface 40.

As shown in FIGS. 7 through 10, the wheel 35 is rotatably engaged with the distal end of the body by the pin 32 passing through the pinholes 33. The wheel 35 has a hole having an inner diameter larger than an outer diameter of the pin 32 so that the wheel is freely rotated around the pin 32.

Referring to FIG. 8, when the spanner is rotated counterclockwise in a state that a bolt is inserted into the spanner head, the ratchet and size-adjustment member B grips the bolt to fasten the bolt. At this time, the bolt holding member D holds the bolt to prevent the bolt from being separated from the spanner head.

As shown in FIGS. 9 and 10, the ratchet and size-adjustment member B has the teethed groove 26 and the wheel 35 freely rotated about the pin 32.

In addition, as shown in FIG. 11, the slide groove has the teeth 15 formed at its lower surface, and the teeth 15 are inclined downward as they go toward a distal end of the spanner head.

Figure 13:
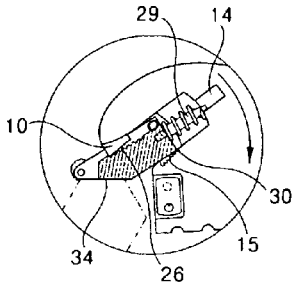
FIG. 13 is an enlarged side view of a self-adjustable universal spanner with a size enlarger during a fastening operation.
Figure 14:
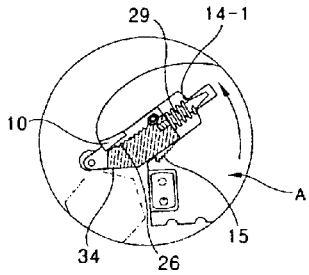
FIG. 14 is an enlarged side view of a self-adjustable universal spanner with a size enlarger during a ratchet operation.

FIG. 13 is an enlarged side view of a self-adjustable universal spanner with a size enlarger during a fastening operation, and FIG. 14 is an enlarged side view of a self-adjustable universal spanner with a size enlarger during a ratchet operation.

As shown in FIG. 13, when the spanner head is rotated clockwise in order to fasten the bolt, a rear end of the ratchet and size-adjustment member B is in contact with the teeth 15, and the teethed groove of the ratchet and size-adjustment member B is in contact with a front end of the guide rail so that the bolt can be securely fastened.

On the other hand, as shown in FIG. 14, when the spanner head is rotated counterclockwise in order to unfasten the bolt, the conical rod 29 is guided into the cylindrical groove 14 so that the ratchet and size-adjustment groove B is retreated backward. At this time, the wheel 35 is freely rotated by a peripheral surface of the bolt to help the ratchet and size-adjustment member B to be readily retreated.

Figure 15:
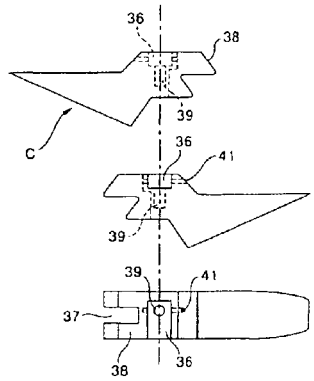
FIG. 15 is a side plan view of a size enlarger.

FIG. 15 is side plan view of a size enlarger. As shown, the size enlarger C includes the stepped sidewalls 38 formed at its one end and the guide groove 37 inserted into the stepped projection 21, the fixing member 44 for fixing the size enlarger to one of two steps, the receiving groove 36 for receiving the fixing member 44. The cylindrical groove 39 is formed at the receiving groove 36, and the ball 42 and the spring 43 are inserted into the cylindrical groove 39 to bias the fixing member 44 upward. The contact surface 40 is formed under the stepped sidewalls 38 to be in contact with the sloped surface 22 of the spanner head A.

Figure 16:
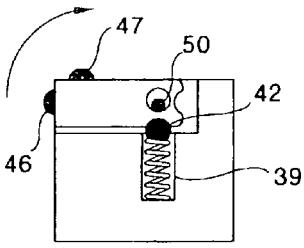
FIG. 16 is a side view of a folded fixing member of a size enlarger.
Figure 17:
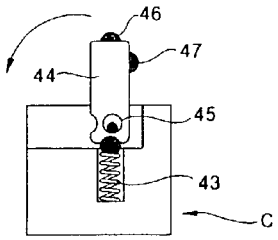
FIG. 17 is a side view of a deployed fixing member of a size enlarger.
Figure 18:
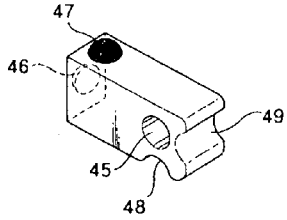
FIG. 18 is a perspective view of a fixing member of a size enlarger.

FIG. 16 is a side view of a folded fixing member of a size enlarger, FIG. 17 is a side view of a deployed fixing member of a size enlarger, and FIG. 18 is a perspective view of a fixing member of a size enlarger.

The fixing member 44 has the pinhole 45 through which the pin 50 passes, the semi-circular grooves 48 and 48 formed at one end and a lower surface thereof corresponding to positions of two steps of the size enlarger C, and the semi-spherical projections formed at the other end and an upper surface thereof corresponding to the semi-circular grooves 19 and 20 above the stepped projection 21. The pin 50 passes through the pinhole 45 and pinholes 41 of the size enlarger C so that the fixing member 44 can be pivoted about the pin 50.

At this time, the pinhole 45 has an inner diameter larger than a diameter of the pin 50 so that the pinhole is cooperated with the spring 39 and the ball 42 to resiliently pivot the fixing member.

As can be seen from the foregoing, a self-adjustable universal spanner with a size enlarger in accordance with the present invention is capable of fastening or unfastening various sizes of bolts more than using one spanner head.

In addition, it is possible to fasten bolts and nuts using a user's one hand by employing a bolt holding member.

While this invention has been described in connection with what is presently considered to be the most practical and preferred embodiment, it is to be understood that the invention is not limited to the disclosed embodiment, but on the contrary, it is intended to cover various modification within the spirit and the scope of the Invention, which is set forth in the appended claims.

What is claimed is:

1. A self adjustable universal spanner with variable sizing comprising:

a head portion having opposing jaws and an intermediate thumb defining an upper slide groove and a lower groove on opposite sides thereof;

a ratcheting size-adjustment member reciprocal within the upper slide groove; and a jaw sizing member movable in the lower groove in a stepped manner to define a width between the ratcheting size-adjustment member and the jaw sizing member such that the spanner can fasten and unfasten various sizes of bolts, wherein the upper slide groove includes:

a guide rail projecting from an upper surface of the slide groove, a sloped surface formed at a distal end of the upper surface of the slide groove, a sidewall formed at one side of the slide groove, a cylindrical groove formed at a rear part of the slide groove, teeth formed on a lower surface of the slide groove; and wherein the lower groove includes a stepped projection formed at a lower part of the head portion, semi-circular grooves formed at an upper surface of the stepped projection, and a sloped surface formed at a lowermost part of the head portion.

2. The self adjustable universal spanner with variable sizing according to claim 1, wherein the ratcheting size-adjustment member includes a body, a conical rod engaged with the body at one end and inserted into the cylindrical groove of the slide groove, a coil spring installed around the conical rod, a wheel engaged with one end of the body, and a guide groove having teeth formed on an upper surface of the ratcheting size-adjustment member.

3. The self adjustable universal spanner with variable sizing according to claim 2, wherein the jaw sizing member includes stepped sidewalls formed at one end and a guide groove inserted into the stepped projection, a fixing member for fixing the jaw sizing member to one of two steps, a receiving groove for receiving the fixing member, a cylindrical groove formed at the receiving groove, and a ball and a spring inserted into the cylindrical groove to bias the fixing member upward.

4. The self adjustable universal spanner with variable sizing according to claim 3, further comprising:

seating grooves formed between the upper slide groove and the lower groove, and having a threaded hole and a pair of semi-spherical grooves at both sides thereof; and a pair of bolt holding members having a threaded hole through which a screw is engaged, and a semi-spherical projection corresponding to the semi-spherical groove.

5. The self adjustable universal spanner with variable sizing according to claim 3, wherein a contact surface is formed under the stepped sidewalls to be in contact with the sloped surface of the body portion.

6. The self adjustable universal spanner with variable sizing according to claim 3, wherein the fixing member has a pinhole through which a pin passes, semi-circular grooves formed at one end and a lower surface thereof corresponding to positions of two steps of the jaw sizing member, and semi-spherical projections formed at the other end and an upper surface thereof corresponding to the semi-circular grooves above the stepped projection.

7. The self adjustable universal spanner with variable sizing according to claim 6, wherein the pin passes through the pinholes of the jaw sizing member such that the fixing member can be pivoted about the pin.

8. The self adjustable universal spanner with variable sizing according to claim 6, wherein the pinhole has an inner diameter larger than a diameter of the pin so that the pinhole is cooperated with the spring and the ball to resiliently pivot the fixing member.

9. The self adjustable universal spanner with variable sizing according to claim 3, wherein, when the jaw sizing member is engaged with the upper part of the stepped projection to fasten various sizes of bolts, the semi-spherical projection of the fixing member is inserted into the semi-circular groove of the spanner head, and when the jaw sizing member is engaged with the lower part of the stepped projection to fasten the other sizes of bolts, the semi-spherical projection of the fixing member is inserted into the semi-circular groove of the spanner head.

10. The self adjustable universal spanner with variable sizing according to claim 3, wherein, when the spanner head is rotated clockwise in order to fasten the bolt, a rear end of the ratcheting size-adjustment member is in contact with the teeth, and the teethed groove of the ratcheting size-adjustment member is in contact with a front end of the guide rail so that the bolt can be securely fastened.

11. The self adjustable universal spanner with variable sizing according to claim 3, wherein when the spanner head is rotated counterclockwise in order to unfasten the bolt, the conical rod is guided into the cylindrical groove so that the ratcheting size-adjustment groove is retreated backward.

12. The self adjustable universal spanner with variable sizing according to claim 2, wherein a cutout part is formed at one side of the body to help slide movement along the sidewall of the slide groove, a pin is inserted through pinholes formed at both sidewalls of the guide groove to be hooked by the guide rail of the slide groove to prevent the adjustment member from separating from the slide groove, and the wheel is rotatably engaged with a distal end of the body by a pin passing through pinholes.

13. The self adjustable universal spanner with variable sizing according to claim 2, wherein the wheel has a hole having an inner diameter larger than an outer diameter of the pin so that the wheel is freely rotated around the pin.

14. The self adjustable universal spanner with variable sizing according to claim 1, wherein the slide groove has the teeth formed at its lower surface, and the teeth are inclined downward toward a distal end of the spanner head.

* * * * *